US005242256A

United States Patent [19]

Appel

[11] Patent Number: 5,242,256

[45] Date of Patent: Sep. 7, 1993

[54] MANIPULATOR FOR RECEPTACLES

[75] Inventor: Max Appel, Aalen, Fed. Rep. of Germany

[73] Assignee: Rico - Maschinenbau Max Appel KG, Aalen/Wurtt, Fed. Rep. of Germany

[21] Appl. No.: 830,403

[22] Filed: Jan. 31, 1992

[30] Foreign Application Priority Data

Jan. 31, 1991 [DE] Fed. Rep. of Germany ... 9101063[U]

[51] Int. Cl.[5] ..... B66C 1/48

[52] U.S. Cl. ..... 414/416; 414/626; 294/88; 294/65; 294/100; 53/235

[58] Field of Search ..... 414/416, 626; 294/27.1, 294/31.1, 33, 88, 90, 93, 119.3, 100, 64.1, 65; 53/246, 247, 249, 250, 235, 244

[56] References Cited

U.S. PATENT DOCUMENTS

| | | | |
|---|---|---|---|
| 2,873,996 | 2/1959 | McHugh, Jr. | 294/90 |
| 2,962,856 | 12/1960 | Ingham, Jr. | 294/65 X |
| 3,086,805 | 4/1963 | Dardaine et al. | 414/416 X |
| 3,643,992 | 2/1972 | Jacobucci | 294/65 |
| 4,793,762 | 12/1988 | Munch et al. | 414/416 |
| 5,029,925 | 7/1991 | Rietzler | 294/100 |

*Primary Examiner*—Frank E. Werner
*Attorney, Agent, or Firm*—Herbert Dubno

[57] ABSTRACT

The individual grippers of a gripper head provided for simultaneously introducing a number of bottles into a box or removing them from the box, where the bottles have neck diameters close to the diameter of the body of the bottle, have polygonal external cross sections with even numbers of sides so that the cylindrical sockets can lie close together. The sockets receive elastic inserts which are actuatable by pistons.

7 Claims, 2 Drawing Sheets

MANIPULATOR FOR RECEPTACLES

FIELD OF THE INVENTION

My present invention relates to a manipulator or gripping device for removing a multiplicity of receptacles, usually bottles, from a container or for inserting such receptacles into a container, generally a case, carbon or box in which the receptacles are stored or shipped. More particularly, the invention relates to a gripper device for the simultaneous handling of a number of such receptacles where the receptacles have necks of a diameter not substantially less than the diameter of the body of the receptacle.

BACKGROUND OF THE INVENTION

It is known to provide a gripper device or manipulator for receptacles such as bottles having necks engageable in individual grippers of the manipulator where the number of grippers mounted in the gripper head or manipulator head is equal to the number of bottles to be inserted simultaneously into a box or other container or to be withdrawn from a box or other container.

The grippers can have hollow cylindrical sockets into which the neck of the bottle can be introduced and an elastic insert which can be axially compressible by a piston to enable the elastic insert to grip or release the neck of the bottle.

The individual grippers or their elastic inserts have configurations similar to that of a tulip and can be referred to as packing tulips or tulip elements.

A gripper system of this type is described in German patent 38 19 598 and has been found to be highly satisfactory. However, the individual grippers of this system have a cylindrical outer configuration and, because the socket itself must have a certain minimum diameter, the cylindrical configuration limits the center to center spacing of the sockets and hence the center to center spacing of the receptacles or bottles which are to be handled. In other words, in many cases, this type of gripper arrangement could not have the center to center spacing of the containers in a box.

As a result, especially with bottles whose neck diameters are only slightly smaller than the body diameters, gripper systems of this type could not be used. As a more general matter, whenever the diameters of the grippers were such that the center to center spacing exceeded center-to-center spacing of the bottles in the package to be formed or from which the bottles were to be withdrawn, the system could not be used either.

OBJECTS OF THE INVENTION

It is, therefore, the principal object of the present invention to provide a gripper arrangement whereby relatively wide-mouth containers can be handled without the difficulties outlined above.

Still another object of the invention is to provide a gripper apparatus or device having individual grippers for insertion of receptacles like bottles into a box or removal of bottles from a box, whereby the center-to-center spacing of the grippers can be reduced, especially for handling of bottles whose neck diameters are only slightly less than the body diameters of the bottles.

It is also an object of this invention to provide a device for the handling of receptacles which can avoid the drawbacks of prior art systems.

SUMMARY OF THE INVENTION

These objects and others which will become apparent hereinafter are attained, in accordance with the invention, by providing the outer surfaces of the packing outlets, grippers or sockets so that in cross section taken perpendicular to the axis, the periphery corresponds to a regular polygon with an even number of sides.

More specifically, the manipulator for introducing a plurality of receptacles in common into or removing a plurality of receptacles in common from container can comprise:

- a packing head; and
- a plurality of grippers mounted on the head and each engageable with a respective one of the receptacles, the receptacles generally having neck diameters only slightly smaller than body diameters, each of the grippers comprising:
- a socket of regular-polygon external cross section with an even number of sides,
- a hollow cylindrical cavity within the socket opening at a mouth at one end of the socket to receive a neck of a respective receptacle,
- a respective tubular elastic insert in the cavity and braced therein at one end of the insert proximal to the mouth, the elastic insert being axially compressible in the cavity and selectively engageable with a receptacle extending into the insert, and
- a piston axially displaceable in the cavity and bearing upon an opposite end of the insert turned away from the mouth.

The apparatus thus has the advantage that the wall thickness of each gripper or socket in closest proximity to an adjoining socket can be very small, i.e. a particularly thin wall construction can be used, permitting very small center-to-center spacing of the sockets, while nevertheless affording the stability, strength and other rigidity factors, contributed by the corner regions, which are necessary to allow the structure to be reliably employed for the manipulation of the receptacles.

The packing tulips or grippers can externally lie against one another with flat side against the adjoining flat side and yet have small center-to-center spacings.

Preferably the cross sections of the grippers are four or six sided. Four-side or square grippers can be used for the introduction of bottles into conventional boxes in longitudinal or transverse rows in a square pattern. It is also possible to stagger one row relative to the next row by half the distance between the bottles of the rows and thus provide a hexagonal packed arrangement. In that case, a hexagonal configuration of the grippers is preferred.

It has been found to be advantageous, moreover, to form the grippers with sleeve portions formed with the polygonal cross section and the cylindrical socket, and a flange portion which closes the end of the sleeve portion at which the piston is provided. The flange portion can have a cylindrical boss which can extend into the cavity of the sleeve portion and can be provided in its corners with holes through which screws can extend into threaded bores of the sleeve portion to secure the flange portion thereon.

To provide an effective seal between the sleeve portion and the flange portion, the boss can have a circumferential groove in which a sealing ring is received.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
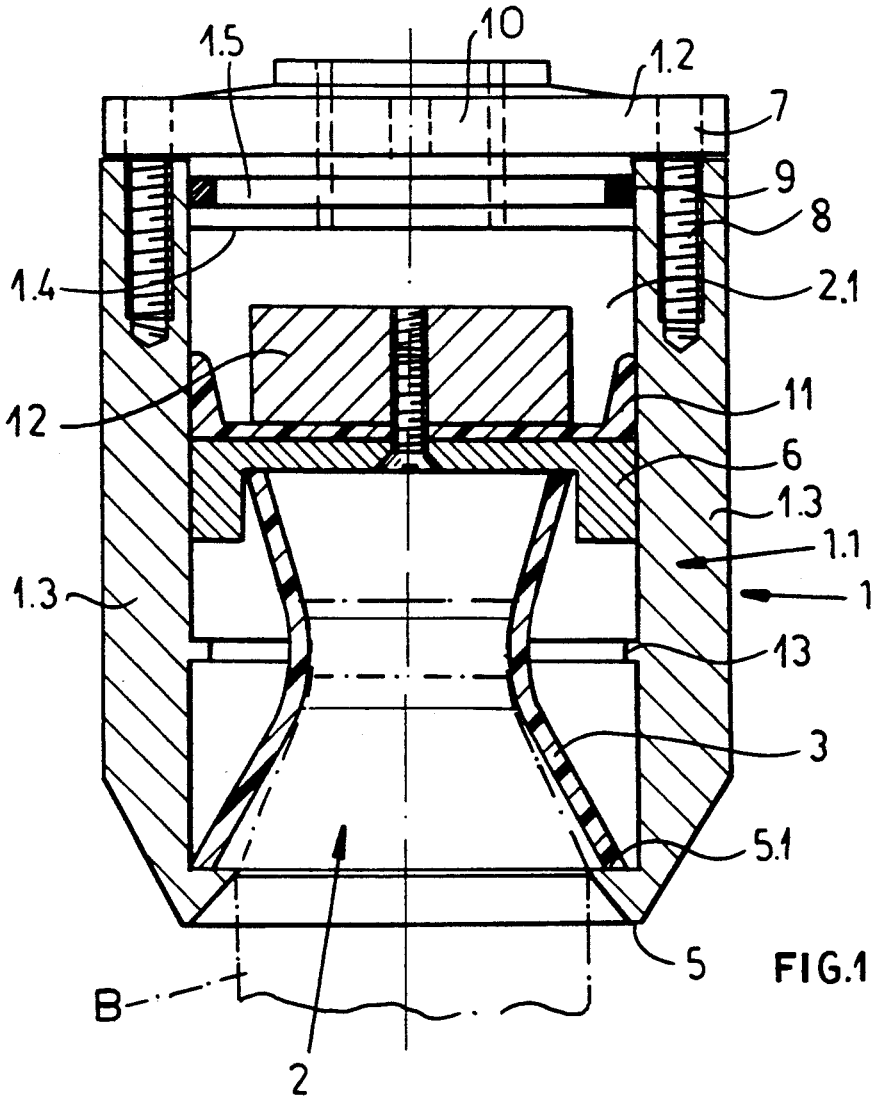
FIG. 1 is a longitudinal section of a gripper for use in a gripper head having a multiplicity of such grippers and taken along a line I—I in FIG. 2.
Figure 3:
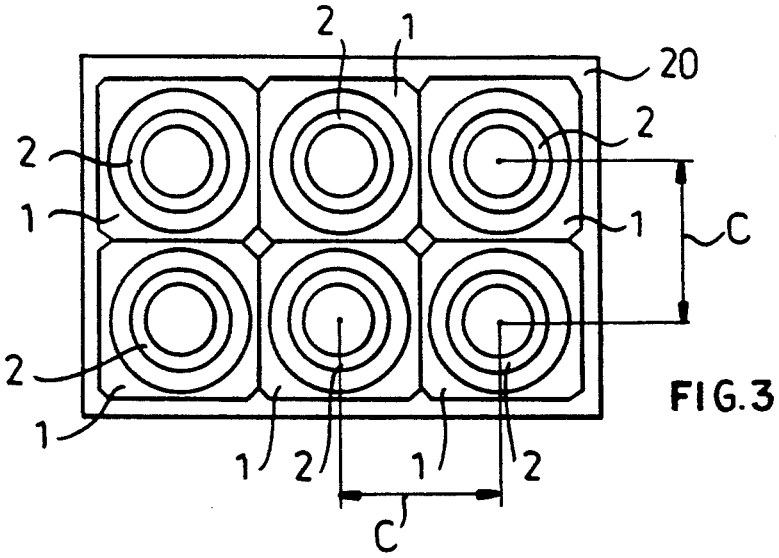
FIG. 3 is a bottom view of a removal of such grippers and the gripper head to which these grippers are common.

The gripper assembly shown in FIG. 3 is intended to be used to insert six bottles into a box or withdraw six bottles simultaneously from the box, the bottles generally having the configuration shown at B in FIG. 1. The individual grippers are positioned close together as can be seen at 1 in FIG. 3 on the common head 20 so that their center-to-center spacings can be small as well.

Figure 2:
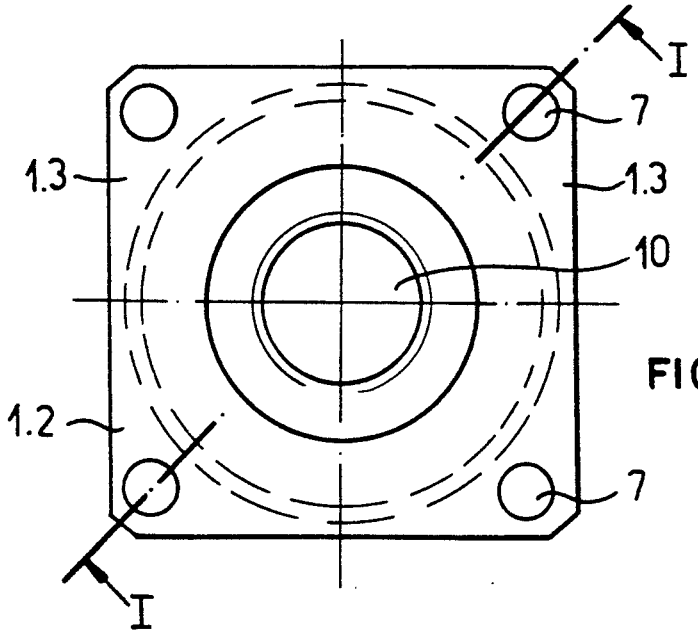
FIG. 2 is a plan view of the flange portion of the gripper of FIG. 1, the supporting head having been removed.

In FIGS. 1 and 2, only a single gripper 1 is shown. The grippers are intended to be used for the handling of bottles which have neck diameters only slightly smaller than their respective body diameters. The arrangement and number of the grippers 1 on each packing head 20 will depend upon the number of receptacles to be inserted into or removed from the respective box.

Each of the grippers 1 has a hollow cylindrical socket 2 into which the bottle can reach and within the socket 2 an elastic tulip-shaped insert 3 shown to be slightly compressed axially in FIG. 1.

At one end, each insert 3 is braced against a shoulder 5.1 of the sleeve portion 1.1 of the gripper adjacent the mouth 5 thereof.

At its opposite end, the insert 3 is engaged by a piston 6 which is axially shiftable in the cavity 2 by fluid pressure introduced into a compartment 2.1.

The outer shape of the gripper 1, taken in cross section perpendicular to the axis of the socket 2, is that of a regular polygon whose number of sides is an even number, for example four in the illustration of FIGS. 1–3. This allows the individual grippers 1 to be packed together a minimum distance between them and permits, as can be seen from FIG. 2, the wall thickness to be relatively small where the cylindrical sockets of adjoining grippers approach one another most closely. The even number of sides ensures that each two opposite sides are planar and parallel to one another. The corner regions shown at 1.3, however, can be somewhat thicker and can provide the requisite structural strength and stability.

Figure 5:
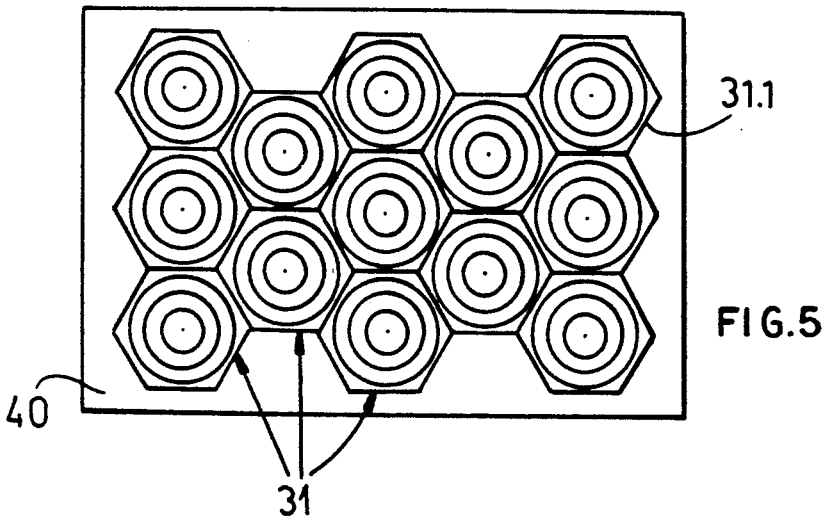
FIG. 5 is a view of an assembly of such grippers on a common gripper head which is intended to allow a staggered collection of receptacles to be handled.
Figure 4:
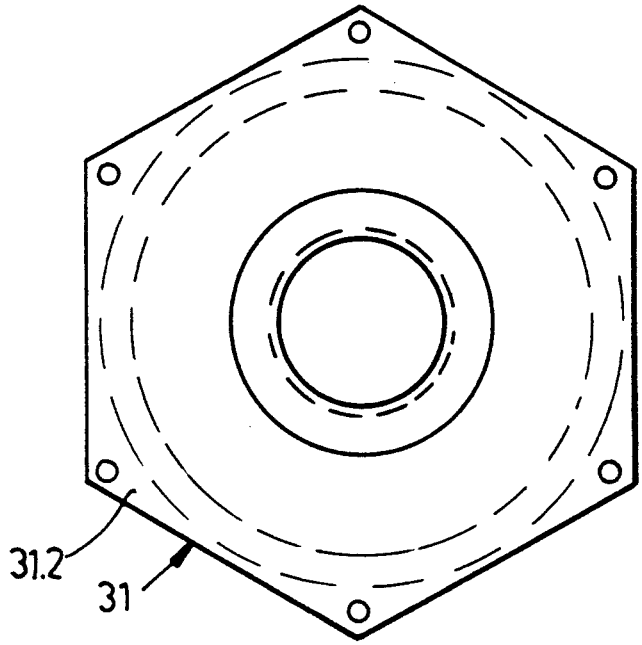
FIG. 4 is a view similar to FIG. 2 of a portion of a hexagonal gripper.

The grippers can also be hexagonal grippers as represented in FIG. 4 at 31. With four-sided grippers, parallel longitudinal and transverse rows of bottles can be provided in a square pattern as will be apparent from FIG. 3, whereas for hexagonal grippers as shown in FIG. 5 on the head 40, the bottles may be handled in a hexagonal pattern with each row staggered relative to the next by half the distance between the grippers and bottle of the row.

Each gripper 1, 31 can comprise a sleeve portion 1.1, 31.1 and a flange portion 1.2, 31.2. Each flange portion 1.2 can be formed with a cylindrical boss 1.4, for example (FIG. 1) provided with a circumferential groove 1.5 receiving a sealing ring, e.g. an O-ring 9, sealing against the inner surface of the cylindrical cavity 2. The flange portion can be provided with thickening bores 7 into which screws can pass from the head 20 or 40 to threadedly engage threaded bores 8 of the sleeve portion. The seal 9 permits the pressure build-up by compressed air or a hydraulic medium introduced through the threaded fitting 10 in the flange portion to displace the piston 6.

The piston 6 is provided with a sealing element 11 which slidably engages the inner wall of the sleeve portion 1.1 and which is anchored between the piston 6 and a spacer 12 threadedly connected with the piston 6 and preventing the sealing element from being forced against the flange part 1.1 when the pressure in the compartment 2.1 is relieved.

A radially inwardly-extending annular shoulder 13 is provided on the inner wall of the sleeve part 1.1 to limit the stroke of the piston 6. The displacement of the piston, of course, controls the engagement and release of the bottle by constricting or spreading the insert 3.

I claim:

1. A manipulator for selectively introducing a plurality of receptacles in common into and removing a plurality of receptacles in common from a container, comprising:

a packing head; and a plurality of grippers mounted on said head and each engageable with a respective one of said receptacles, said receptacles generally having neck diameters only slightly smaller than body diameters, each of said grippers comprising:

a socket of regular-polygon external cross section with an even number of sides, a hollow cylindrical cavity within said socket opening at a mouth at one end of said socket to receive a neck of a respective receptacle, a respective tubular elastic insert in said cavity and braced therein at one end of said insert proximal to said mouth, said elastic insert being axially compressible in said cavity and selectively engageable with a respective one of said receptacles extending into said insert, and a piston axially displaceable in said cavity and bearing upon an opposite end of said insert turned away from said mouth for expanding and contracting said insert, each of said sockets laterally abutting a plurality of other sockets of other grippers with respective said sides thereof.

2. The manipulator defined in claim 1 wherein said polygon is a four-sided polygon.

3. The manipulator defined in claim 1 wherein said polygon is a six-sided polygon.

4. The manipulator defined in claim 1 wherein said grippers are each formed with a sleeve portion and a flange portion, said flange portion having a cylindrical boss fitting into said cavity, said flange portion being formed at corners thereof with throughgoing bores adapted to receive screws securing said flange portion to said sleeve portion.

5. The manipulator defined in claim 4 wherein said boss is formed with an outwardly open circumferential groove, each gripper having a sealing ring received in the respective groove.

6. The manipulator defined in claim wherein said polygon is a four-sided polygon.

7. The manipulator defined in claim 5 wherein said polygon is a six-sided polygon.

* * * * *